US008356670B2

(12) United States Patent
Telfer

(10) Patent No.: US 8,356,670 B2
(45) Date of Patent: Jan. 22, 2013

(54) BALL SEAT ASSEMBLY AND METHOD OF CONTROLLING FLUID FLOW THROUGH A HOLLOW BODY

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 544 days.

(21) Appl. No.: 12/594,005

(22) PCT Filed: Mar. 14, 2008

(86) PCT No.: PCT/GB2008/000904

§ 371 (c)(1),
(2), (4) Date: Feb. 4, 2010

(87) PCT Pub. No.: WO2008/119931

PCT Pub. Date: Oct. 9, 2008

(65) Prior Publication Data

US 2010/0132954 A1 Jun. 3, 2010

(30) Foreign Application Priority Data

Mar. 31, 2007 (GB) ..... 0706350.6

(51) Int. Cl.
*E21B 34/08* (2006.01)

(52) U.S. Cl. ..... 166/318; 166/329; 166/373; 166/193; 166/194

(58) Field of Classification Search ..... 166/318, 166/329, 193, 194, 373
See application file for complete search history.

(56) References Cited

U.S. PATENT DOCUMENTS

| | | | | |
|---|---|---|---|---|
| 4,502,542 | A | 3/1985 | Thurman et al. | |
| 4,729,432 | A | 3/1988 | Helms | |
| 5,181,569 | A | 1/1993 | McCoy et al. | |
| 7,469,744 | B2 * | 12/2008 | Ruddock et al. | 166/242.1 |
| 7,637,323 | B2 * | 12/2009 | Schasteen et al. | 166/318 |
| 2011/0315389 | A1 * | 12/2011 | Crider et al. | 166/329 |
| 2011/0315390 | A1 * | 12/2011 | Guillory et al. | 166/329 |

OTHER PUBLICATIONS

International Search Report from PCT/GB2008/000904 dated Jul. 7, 2008 (3 pages).
Written Opinion from PCT/GB2008/000904 dated Jul. 7, 2008 (7 pages).

* cited by examiner

*Primary Examiner* — Giovanna Wright
(74) *Attorney, Agent, or Firm* — Osha Liang LLP

(57) ABSTRACT

A method of controlling fluid flow through a hollow body, uses a ball seat assembly (12) comprising a hollow body (14) defining a bore (16) and a ball seat (18) mounted said bore, the ball seat being moveable relative to the bore between an extended position in which the seat defines a restriction to passage of a ball (20) along the bore, and a retracted position spaced axially along the bore from the extended position and in which position passage of the ball along the bore is permitted. A subsequent reduction in the fluid pressure force acting on the ball seat facilitates movement of the seat from the extended position shown in the upper half of FIG. 1, to the retracted position shown in the lower half of the Figure, to permit passage of the ball through the bore to thereby re-open fluid flow through the bore.

38 Claims, 6 Drawing Sheets

BALL SEAT ASSEMBLY AND METHOD OF CONTROLLING FLUID FLOW THROUGH A HOLLOW BODY

TECHNICAL FIELD OF THE INVENTION

The present invention relates to a ball seat assembly and to a method of controlling fluid flow through a hollow body. In particular, but not exclusively, the present invention relates to a ball seat assembly having a ball seat which selectively defines a restriction to passage of a ball along a bore of a hollow body, and to a method of controlling fluid flow through a hollow body using such a ball seat.

BACKGROUND TO THE INVENTION

In the oil and gas exploration and production industry; a wellbore or borehole of an oil or gas well is typically drilled from surface to a first depth and lined with a steel casing which is cemented in place. The borehole is then extended and a further section of smaller diameter casing is located in the extended section and also cemented in place. This process is repeated until the wellbore has been extended to a certain depth, and tubing known as a liner is then typically located in the borehole, extending from the deepest casing section (the casing 'shoe') to a producing formation. The well is then completed by locating a string of production tubing within the casing/liner and perforating the liner such that well fluids may flow from a producing formation, into the liner, and through the production tubing to surface.

The location of a liner extending from a casing shoe typically involves hanging the liner from the casing shoe using a liner hanger. Liner hangers include mechanical slips or the like which are selectively activated downhole to grip the internal wall of the casing, so that the liner may be suspended from the casing shoe and then cemented in place. Such liner hangers are typically run into the casing on a workstring carrying a liner setting tool, and are hydraulically actuated on exposure to fluid above a specified setting pressure, which urges the slips outwardly into engagement with the casing wall. These setting pressures are typically significantly higher than the hydrostatic pressure at depth within the well borehole, to prevent premature activation of the hanger.

To activate the hanger and thus to set the liner within the casing, it is necessary to close off fluid flow down through the workstring and the liner using the setting tool, so that the pressure of the fluid above the setting tool can be raised above the determined level necessary to activate the hanger. Currently, this is typically achieved by providing a setting tool including a ball seat which receives a ball dropped into the workstring from surface. The ball passes down into the setting tool, and lands on the ball seat to close fluid flow through the liner. The fluid above the tool is then pressured up, activating the hanger to set the liner. A further increase in fluid pressure acting on the ball (and thus on the ball seat) shears pins holding the ball seat in place. The ball seat is then carried down to a position where the seat is desupported, so that the ball can pass through the seat and exit the setting tool. Fluid flow through the liner has then been re-opened and the setting tool and workstring can be recovered to surface.

Whilst the above described tools and methods are effective at setting liner hangers within a casing, such ball seats are typically rated to shear at a relatively high pressure, typically 3000 psi or more, in order to prevent premature shearing out of the ball seat. At these high pressures, when the ball shears the seat out, there is an undesirable hydraulic shock imparted to the workstring carrying the liner/setting tool, and indeed to the surrounding rock formations, which can cause serious damage.

Similar such problems are encountered where other downhole tools are provided with ball seats that shear out at such high pressures, and indeed other types of ball seats and balls which operate at high pressures. Such alternative structures include those with deformable balls or ball seats, which permit blow-through of a ball at determined pressures. Typical such alternative tools include those utilised to selectively circulate fluid into an annulus between a workstring and the wall of a casing, to assist in a casing cleaning procedure, although it will be understood that many different types of downhole tool are activated in this way.

It is therefore amongst the objects of embodiments of the present invention to obviate or mitigate at least one of the foregoing disadvantages.

SUMMARY OF THE INVENTION

According to a first aspect of the present invention, there is provided a ball seat assembly comprising:

a hollow body defining a body bore; and a ball seat mounted within the body bore, the ball seat being movable relative to the body bore between an extended position in which the ball seat defines a restriction to passage of a ball along the body bore, and a retracted position spaced axially along the body bore from the extended position and in which position passage of a ball along the body bore is permitted;

wherein, in use, landing a ball on the ball seat when in the extended position restricts fluid flow though the body bore, causing an increase in a fluid pressure force acting on the ball seat for a given fluid pressure;

and further wherein a subsequent reduction in the fluid pressure force acting on the ball seat facilitates movement of the ball seat from the extended position to the retracted position, to permit passage of the ball through the body bore to re-open fluid flow therethrough.

Providing a ball seat assembly where the ball seat is moveable to a retracted position, facilitating passage of the ball through the ball seat and thereby re-opening fluid flow through the body bore, in response to a reduction in the fluid pressure force acting on the ball seat, offers significant advantages over prior ball seat assemblies. This is because it is not necessary to expose the ball to high pressures in order to re-open flow through the body bore. This reduces the risk of damage both to downhole components and surrounding geological formations.

The ball seat may be movable to the retracted position by a subsequent reduction in the pressure of fluid acting on the ball and thus on the ball seat.

The ball seat may be moveable from the extended position to the retracted position in an uphole direction. It will be understood that references herein to movement in an uphole direction are to movements within a borehole in a direction towards the surface. References to movement in a downhole direction should therefore be construed accordingly. The ball may be adapted to be passed down into the body bore in a first axial direction, and the ball seat may be selectively moveable relative to the body bore in a second axial direction opposite to said first axial direction between the extended and retracted positions.

The body may comprise a recess, channel, groove or the like which may extend around an internal surface of the body and which may be adapted to receive at least part of the ball seat when the ball seat is moved from the extended position to the retracted position.

The assembly may comprise a control mechanism for controlling movement of the ball seat from the extended position to the retracted position, to selectively permit passage of a ball along the body bore and thus to selectively re-open fluid flow therethrough. The control mechanism may be activatable to move the ball seat from the extended position to the retracted position in response to the reduction in the fluid pressure force applied to the ball seat and thus to the ball when seated on the ball seat in the extended position.

The control mechanism may comprise a biasing member such as a spring for exerting a biasing force on the ball seat, to bias the ball seat towards the retracted position.

The control mechanism may comprise a restraint for restraining the ball seat against movement relative to the body bore. The restraint may be adapted to release the ball seat for movement relative to the body bore on exposure of the ball seat to a fluid pressure force at or above a determined level. It will be understood that this fluid pressure force will depend upon the pressure of fluid acting on the ball and the dimensions of the ball seat and the ball. The restraint may take the form of a shear pin and may be rated to shear at or above a fluid pressure force acting on the ball seat which is greater than a typical range of operating pressures experienced downhole. This may prevent premature release of the ball seat for movement relative to the body bore.

The ball seat may comprise at least one ball seat element which may be radially moveable relative to the body bore between the extended and retracted positions. In an embodiment of the invention, the ball seat comprises a plurality of ball seat elements which together define or describe the ball seat. The ball seat elements may take the form of arcuate dogs, the dogs together defining a generally annular ball seat when the dogs are in their respective extended positions. In the extended position of the ball seat, the body may support the ball seat, and the body may comprise a body portion defining a shoulder or the like adapted to abut the ball seat, to support and maintain the ball seat in the extended position. The body portion adapted to abut the ball seat may define or describe an internal diameter which, when the ball seat is located axially overlapping or adjacent to said portion, maintains the ball seat in the extended position defining the restriction.

The control mechanism may comprise a support member such as a sleeve or a cage coupled to the ball seat such that movement of the ball seat from the extended position to the retracted position is governed by the support member. Where the assembly comprises a biasing member for urging the ball seat towards the retracted position, the biasing member may be adapted to act on the support member to thereby urge the ball seat towards the retracted position. The support member may comprise at least one aperture for receiving the ball seat and, where the ball seat comprises a plurality of ball seat elements, may comprise an aperture for each ball seat element, which ball seat elements may be mounted for radial movement relative to the body bore within the respective apertures.

The ball seat assembly may comprise a collet comprising a plurality of sprung or resilient collet fingers, the collet fingers together defining the ball seat. The collet fingers may each comprise finger portions having inner surfaces each defining part of a surface of the ball seat and adapted to abut the ball. The finger portions may be of a larger radial thickness relative to at least an adjacent portion of the fingers, and may be adapted to engage in the recess or the like in the body when the ball seat is moved to the retracted position. It will therefore be understood that the finger portions of the collet fingers may be adapted to spring out into the recess to restrain the ball seat in the retracted position. The finger portions may comprise surfaces which are inclined, in use, in a downhole direction to resist movement of the ball seat from the retracted position.

The control mechanism may comprise an indexing arrangement including an indexing sleeve coupled to the ball seat, the indexing sleeve comprising an indexing channel extending at least part way around a circumference of the sleeve, and at least one indexing pin adapted to engage within the indexing channel. The indexing sleeve may be mounted for movement within the body of the assembly and the pin may be mounted extending through a wall of the body. In this fashion, movement of the indexing sleeve relative to the body may be controlled by an interaction between the pin and the channel. The indexing channel may comprise a plurality of axially and/or circumferentially spaced detent positions, and may comprise at least one first detent position in which the ball seat is in the extended position; and at least one second detent position, axially and/or circumferentially spaced from the first detent position, in which the ball seat is in the retracted position. The indexing channel may comprise at least one further detent position, which may be an intermediate detent position. The further detent position may be axially and/or circumferentially spaced from the first and/or second detent positions. In the further detent positions, the ball seat may be in a further position, in which the ball seat maintains a restriction to passage of a ball through the body bore, and said further position of the ball seat may be axially spaced from the further extended position. Location of the ball seat either at the first extended position, the further position or at a location between the two positions may be controlled by the fluid pressure force exerted on the ball seat.

The ball seat assembly may be for a downhole tool and, in a preferred embodiment, may be for a tubing setting tool, particularly a liner setting tool.

It will be understood that when, in use, a ball is landed on the ball seat when in the extended position, the ball may be sealingly received by the ball seat to prevent further flow through the body bore past the ball seat. Alternatively, the ball may be received by the ball seat in such a fashion as to substantially prevent fluid flow past the ball seat, but such that fluid communication between a portion of the body bore above the ball seat and a portion below the ball seat may still be permitted. References to permitting passage of the ball through the body bore to re-open fluid flow therethrough should be construed accordingly.

According to a second aspect of the present invention, there is provided a downhole tool comprising a ball seat assembly according to the first aspect of the present invention.

Preferably the downhole tool is a tubing setting tool and may take the form of a liner setting tool.

According to a second aspect of the present invention, there is provided a method of controlling fluid flow through a hollow body, the method comprising the steps of:

mounting a ball seat within a bore of the body;

locating the ball seat in an extended position in which the ball seat defines a restriction to passage of a ball along the body bore;

bringing a ball into abutment with the ball seat, to restrict fluid flow through the body bore and thereby causing an increase in a fluid pressure force acting on the ball seat for a given fluid pressure; and subsequently lowering the fluid pressure force acting on the ball seat, to facilitate movement of the ball seat from the extended position to a retracted position spaced axially along the body bore from the extended position, in which position the ball seat releases the ball and permits passage of the ball along the body bore to thereby re-open fluid flow along the body bore.

The method may be a method of hanging a tubing in a downhole environment, and may be a method of hanging a liner from a larger diameter tubing in a wellbore, which larger diameter tubing may be a casing.

The method may comprise providing a downhole tool, in particular a setting tool, defining the hollow body and controlling fluid flow through the hollow body of the setting tool in order to hang the tubing. The downhole tool may be coupled to the tubing and may serve for actuating a tubing hanger on the tubing. The hanger may be activated by raising fluid pressure in the tool above the ball to activate the hanger, and then reducing the fluid pressure to facilitate movement of the ball seat to the retracted position, to re-open flow.

Alternatively, the method may be a method of selectively activating a downhole tool for carrying out a downhole procedure, and may be a method of selectively activating one or more tools selected from a group comprising a cleaning tool, a packer, a milling tool and a circulation tool. The downhole tool may be activated in a similar fashion to the hanger discussed above.

The method may comprise raising a fluid pressure force acting on the ball after the ball has been brought into abutment with the ball seat, to carry out a further downhole procedure/operation, and/or to release a restraint (such as a shear pin) restraining movement of the ball seat relative to the body bore. This may be achieved by raising the pressure of fluid in the body bore above/upstream/uphole of the ball. Following carrying out of the downhole procedure and/or release of the restraint, the fluid pressure force acting on the ball may be lowered, by lowering the pressure of fluid in the body bore above/upstream/uphole of the ball, to facilitate movement of the ball seat to the retracted position.

According to a fourth aspect of the present invention, there is provided a ball seat assembly comprising:

a hollow body defining a body bore;

a ball adapted to be passed down into the body bore in a first axial direction; and a ball seat mounted within the body bore, the ball seat adapted to receive the ball and being selectively movable relative to the body bore in a second axial direction opposite to said first axial direction between an extended position in which the ball seat defines a restriction to passage of the ball along the body bore, and a retracted position in which passage of the ball along the body bore is permitted.

According to a fifth aspect of the present invention, there is provided a method of controlling fluid flow through a hollow body, the method comprising the steps of:

mounting a ball seat within a bore of the body;

locating the ball seat in an extended position in which the ball seat defines a restriction to passage of a ball along the body bore;

passing a ball into the body bore in a first axial direction and bringing the ball into abutment with the ball seat, to restrict fluid flow through the body bore;

moving the ball seat in a second axial direction opposite to said first direction from the extended position to a retracted position in which the ball seat releases the ball and permits passage of the ball along the body bore to thereby re-open fluid flow along the body bore.

It will be understood that, whilst a ball seat assembly comprising a ball seat defining a restriction to passage of a ball is defined herein, other types of seat assembly, defining restriction to passage of alternative restriction members, are encompassed. Accordingly, a valve seat assembly comprising a valve seat defining a restriction to a valve member may be provided. The valve may be a dart or other suitable member. A corresponding downhole tool and method may also be provided.

Embodiments of the present invention will now be described, by way of example only.

MODES FOR CARRYING OUT THE INVENTION

Figure 1:
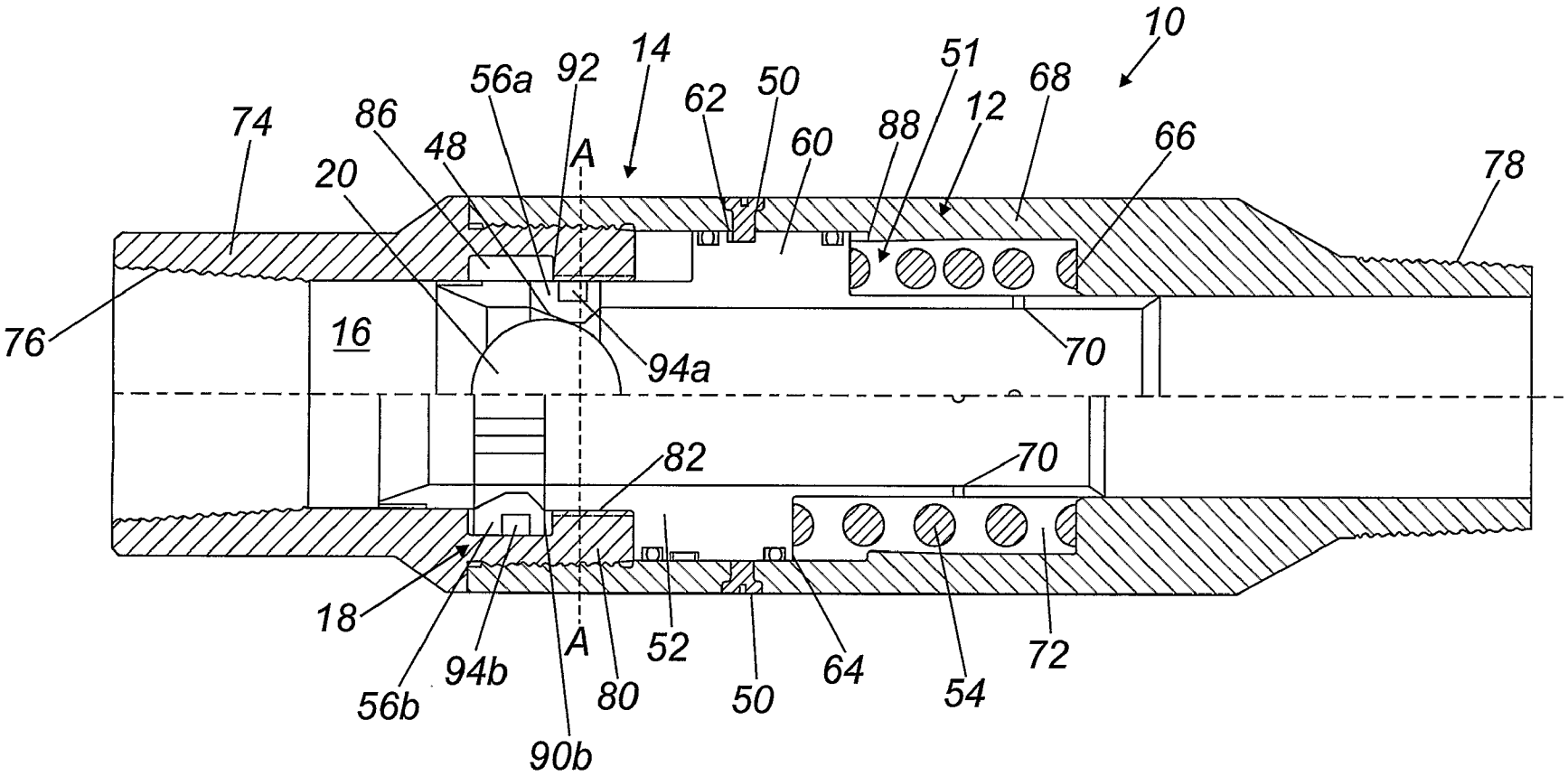
FIG. 1 is a longitudinal cross-sectional view of downhole tool, incorporating a ball seat assembly, in accordance with an embodiment of the present invention, with a ball landed on a ball seat of the assembly and the ball seat shown in an extended position in an upper half of the Figure, and with the ball seat shown in a retracted position in the lower half of the Figure.

Turning firstly to FIG. 1, there is shown a downhole tool 10, incorporating a ball seat assembly indicated generally by reference numeral 12, in accordance with an embodiment of the present invention. As will be described in more detail below, the downhole tool 10 takes the form of a setting tool for setting tubing downhole. The ball seat assembly 12 generally comprises a hollow body 14 defining a body bore 16 and a ball seat 18 mounted within the body bore 16. The ball seat 18 is moveable relative to the body bore 16 between an extended position in which the seat defines a restriction to passage of a ball 20 along the body bore 16, and a retracted position spaced axially along the body bore 16 from the extended position and in which position passage of the ball 20 along the body bore 16 is permitted. The ball seat 18 is shown in the extended position with the ball 20 landed on the seat 18 in the upper half of FIG. 1, and in the retracted position following release of the ball 20 in the lower half of FIG. 1. The setting tool 10 and ball seat assembly 12 are also shown in the sectional view of FIG. 2, which is taken about the line A-A of FIG. 1, and which illustrates the ball seat 18 in the extended position as in the upper half of FIG. 1, but with the ball 20 removed, for ease of illustration.

In use, when the ball 20 is landed on the ball seat 18 in its extended position, the ball 20 restricts fluid flow through the body bore 16, causing an increase in a fluid pressure force acting on the ball seat 18 for a given fluid pressure in the bore 16 above the ball 20. As will be described in more detail below, a subsequent reduction in the fluid pressure force acting on the ball seat 18 facilitates movement of the seat from the extended position shown in the upper half of FIG. 1, to the retracted position shown in the lower half of the Figure, to permit passage of the ball 20 through the body bore 16 to thereby re-open fluid flow through the body bore. Providing a setting tool 10 with a ball seat assembly 12 in which the ball 20 is landed on the ball seat 18 to restrict fluid flow through the body bore 16, and in which the ball seat 18 is subsequently moved to a retracted position to release the ball in response to a reduction in a fluid pressure force acting on the ball seat 18, offers significant improvements over known setting tools. This is because the ball 20 can be released from the ball seat 18 at much lower operating pressures than has previously been the case. This ensures that, when the ball 20 is released, the risk of a hydraulic shock being imparted to a workstring carrying the tool 10, to other downhole components, and to wellbore formations is greatly reduced. Indeed, and as will be described below, the ball seat 18 can be actuated to release the ball at low pressures of around 50 psi or less. Work string equipment and formations are thus protected from unwanted pressure shocks.

The setting tool 10 and the ball seat assembly 12 will now be described in more detail with reference also to FIG. 3, which is a schematic longitudinal, partial sectional view of the setting tool 10 incorporated into a work string 19. The string 19 extends to surface, and a liner 22 is suspended from the string 19. The liner 22 is run through a portion of a wellbore 24 which has been lined with a metal casing 26 that has been cemented at 28 in a fashion known in the art, and into an extended section 30 of the wellbore. The liner 22 is suspended from the work string 19 by a running tool 31, which includes dogs 33 that are actuated to engage the liner 22, and which is sealed relative to the liner. A packer 32 is provided below the running tool 31, to define an annular area 35 between an inner surface 23 of the liner 22 and an outer surface 37 of the setting tool 31. The liner 22 is then run into the wellbore 24 and located in the extended section 30 overlapping a casing shoe 34 (the section of casing provided deepest in the well). A liner hanger 36 is provided at an upper end of the liner 22, and serves for coupling the liner 22 to the casing shoe 34. The liner hanger 36 is hydraulically activated, in a fashion known in the art, and includes slips 38 which, when the hanger is activated, engage an inner surface 40 of the casing 26.

The work string 19 carrying the liner 22 is run-in to the wellbore 24 with the setting tool 10 in a run-in configuration, where the ball seat 18 is held in the position shown in the upper half of FIG. 1. Fluid can flow down through the work string 19, through the tool body bore 16 and on down to the bottom of the liner 22, passing back up an annulus 42 defined between a wall 44 of the extended wellbore section 30 and an outer surface 46 of the liner 22. From there, the fluid flows into the casing 26 to surface. This assists in running and location of the liner 22 within the extended section 30. Once the liner 22 has been brought to a position where it overlaps the casing shoe 34, as shown in FIG. 3, it is then desired to activate the liner hanger 36, to suspend the liner 22 from the casing 26.

To achieve this, the ball 20 is dropped into the work string 19 and passes under gravity and in fluid flowing down through the work string into the setting tool 10. The ball 20 is typically of 2⅛ inch diameter, whilst in the extended position, the ball seat 18 describes a maximum clearance of 2 inches. Accordingly, the ball comes to rest on a seating surface 48 of the ball seat 18. This restricts further flow down through the body bore 16; indeed, the close fit between the ball 20 and the seat 18 ensures that substantially all fluid flow down the body bore 16 past the seat 18 is arrested. For a given fluid pressure in the work string 19, this results in an increase in the fluid force acting on the ball 20 and thus on the ball seat 18. The fluid in the work string 19 above the ball seat 18 can then be pressured-up to activate the liner hanger 36 and thus to bring the slips 38 into engagement with the casing inner surface 40. This is achieved by fluid communication between the setting tool 10 and the hanger 36 through ports 41 (one shown) in the running tool 31. The liner 22 is thus now suspended from the casing 26, and the running tool 31 can be released from the liner 22, the packer 32 deactivated, and the string 19 returned to surface.

During setting of the hanger 36, the pressure of the fluid in the work string 19 above the ball seat 18 is raised above 1000 psi. Above 1000 psi, a number of shear pins 50 (two shown in FIG. 1) of a control mechanism 51 are sheared, releasing a support sleeve 52 of the mechanism 51, which is coupled to the ball seat 18. The support sleeve 52, and thus the ball seat 18, can then move in a downhole direction (to the right in FIG. 1), against the biasing force of a spring 54, thereby compressing the spring. As the fluid pressure required to activate the liner hanger 36 is in excess of 1000 psi, the liner hanger 36 is only activated following shearing of the pins 50. It will therefore be understood that the shear pins 50 serve primarily to lock the ball seat 18 in the extended position during running of the tool 10, such that the ball seat 18 is not prematurely moved to the retracted position. It will also be understood that an actuation pressure of 1000 psi is exemplary, and that the pins 50 may shear at a different pressure, depending upon factors including, inter alia, downhole conditions within the borehole in question, casing diameter and dimensions of other components of the setting tool 10.

Following setting of the liner hanger 36, the fluid pressure in the work string 19 is reduced significantly, and the spring 54 urges the support sleeve 52 in an uphole direction (to the left in FIG. 1). This carries the ball seat 18 to the retracted position, permitting the ball 20 to pass down through the body bore 16 and out of the setting tool 10. Following ejection of the ball 20 from the setting tool 10, fluid flow through the tool is re-opened, to allow further downhole operations including release of the running tool 31 and packer 32, for recovery of the work string 19 to surface.

A suitable ball catcher (not shown) may be provided further down the work string 19 for catching the ball 20, or the ball 20 may carry on down the workstring 19 to a further tool provided deeper in the well, or indeed to a further tool provided within the liner 22. For example, the ball may continue down the liner 22 to operate a differential fill float collar or float shoe (not shown) from a "fill" configuration to a "float" configuration, prior to cementing the liner 22.

The structure and method of operation of the downhole tool 10 will now be described in more detail.

Figure 2:
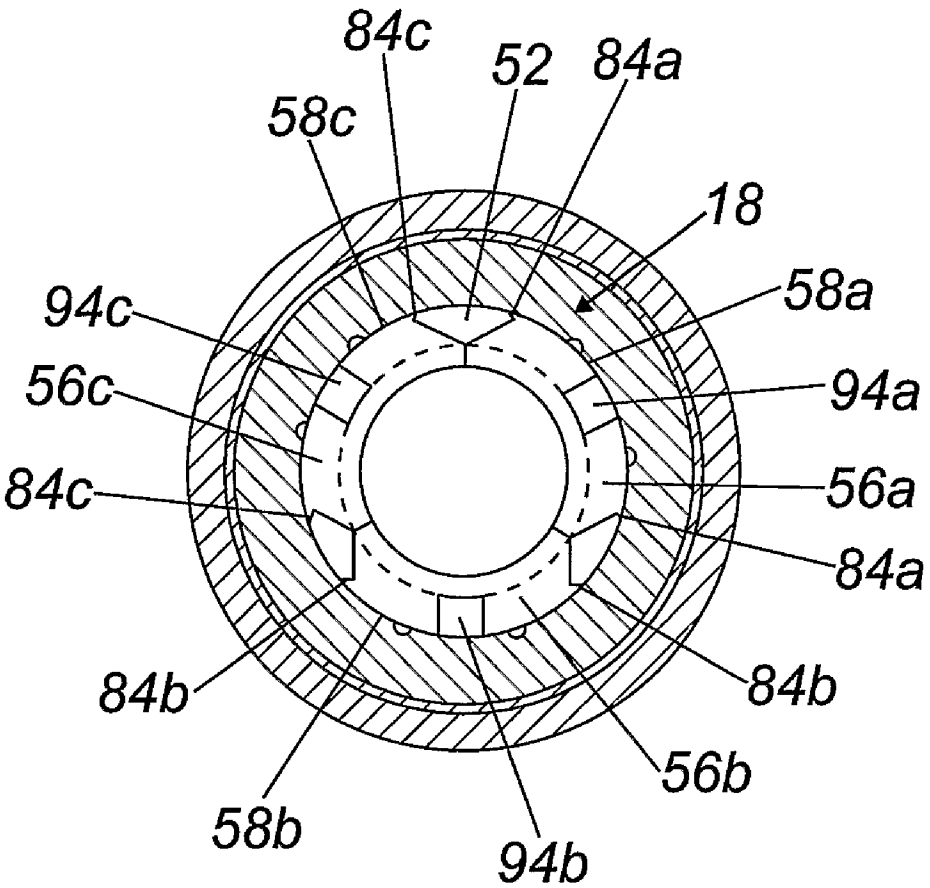
FIG. 2 is a sectional view of the downhole tool of FIG. 1, taken about line A-A and showing the ball seat in the extended position and with the ball removed, for ease of illustration.

The ball seat 18 comprises three ball seat elements in the form of arcuate dogs 56*a*, 56*b* and 56*c*, best shown in the sectional view of FIG. 2. Each dog 56 is mounted in a corresponding aperture 58 extending through the support sleeve 52 and is radially moveable relative to the body bore 16. This permits movement of the dogs 56 between extended and retracted positions shown in the upper and lower halves, respectively, of FIG. 1.

The support sleeve 52 includes a shoulder portion 60 having a circumferentially extending channel 62 in which the shear pins 50 are engaged, to lock the support sleeve 52 against movement during run-in of the setting tool 10, holding the dogs 56 in their extended positions. The spring 54 is located between an end face 64 of the shoulder portion 60 and a shoulder 66 defined by a main portion 68 of the tool body 14. Ports 70 in the support sleeve 52 prevent hydraulic lock by allowing pressure equalisation between a chamber 72 in which the spring 54 is located and the body bore 16.

The body 14 also includes an upper sub 74 which is threaded to the main portion 68, and the upper sub 74 and main portion 68 define respective female box and male pin connectors, for connecting the setting tool 10 into the work string 19. The upper sub 74 includes a shoulder portion 80 having an abutment surface 82 which, when the sleeve 52 is in the position shown in the upper half of FIG. 1, supports the dogs 56 in their extended positions. It will be noted from FIG. 2 that the dogs 56 each include lips 84 along their edges which prevent the dogs from falling out of their apertures 58 into the body bore 16. The upper sub 74 also includes a circumferentially extending recess 86 which is shaped to receive the dogs 56 when the ball seat 18 is moved to its retracted position.

In use, in the run-in configuration of the setting tool 10 shown in the upper half of FIG. 1, the support sleeve 52 is locked against movement relative to the body main portion 68 by the shear pins 50. In this position of the support sleeve 52, the dogs 56 are axially aligned with the upper sub shoulder portion 80, such that the abutment surface 82 holds the dogs in a radially inwardly extended position, defining a restriction to passage of the ball 20. Also in this position of the support sleeve 52, the spring 54 is compressed to a length of around 3.3 inches and exerts a 1410 lb force on the sleeve 52. When the ball 20 is landed on the seat dogs 56, fluid flow through the bore 16 is arrested and the ball 20 raises the fluid pressure force on the seat 18. For a given pressure of fluid in the work string 19 when the ball 20 is run into the tool 10 and landed on the seat 18, a relatively greater fluid pressure force will be exerted on the seat 18. Typically, this fluid pressure force will not be sufficient to shear the pins 50, which ensures that the pins are not prematurely sheared. Fluid in the work string 19 can then be pressured-up, as described above, to activate the liner hanger and this also shears the pins 50. The increased fluid pressure carries the sleeve 52 downwardly, as the spring 54 is rated such that the 1000 psi force required to shear the pins 50 will be sufficient to overcome the spring force applied to the sleeve 52, when the spring is in the compressed state shown in the upper half of FIG. 1. Further application of fluid pressure will further compress the spring 54. However, a shoulder 88 on the body main portion 68 defines a maximum extent of movement of the support sleeve 52. In this position, the spring is compressed to a length of 3 inches and exerts a force of 1622 lb on the sleeve 52.

Following setting of the hanger 36, the fluid pressure force acting on the seat 18 can be reduced by bleeding off pressure in the work string 19. As the shear pins 50 have now been sheared, the spring 54 acts to urge the support sleeve 52 in an uphole direction. As the sleeve 52 moves uphole, it carries the seat dogs 56. The axial length of the upper sub shoulder portion 80 and the dimensions of the dogs 56 are selected such that the dogs 56 can only move out to their retracted positions, shown in the lower half of FIG. 1, at a relatively low pressure of fluid in the work string 19 above the ball 20. This is because, at the point at which trailing edges 90 of the dogs 56 pass beyond a side wall 92 of the recess 86, the spring force exerted by the spring 54 on the support sleeve 52 is relatively low. Indeed, the spring force exerted on the sleeve 52 with the spring 54 at its final length (4.1 inches), shown in the lower half of FIG. 1, is around 846 lb. This equates to a fluid pressure of around 50 psi in the work string 19. Accordingly, at pressures above 50 psi, the fluid pressure force exerted on the dogs 56 by the ball 20 will be sufficient to hold the sleeve 52 down against the biasing force of the spring 54, such that the dogs 56 are maintained in their extended positions by the shoulder portion 80.

Accordingly, it is necessary to greatly reduce pressure of fluid in the work string 19 in order that the dogs 56 be carried a sufficient distance uphole to move out into the recess 86.

On reaching this position, the ball 20 exerts a force on the dogs 56 to urge them radially outwardly into the recess 86, and the ball 20 is then released to pass on through the body bore 16, as described above. Magnets 94 in each dog 56 then hold the dogs 56 in the recess 86, effectively locking the dogs out and securing the support sleeve 52 against return movement against the biasing force of the spring 54.

Figure 4:
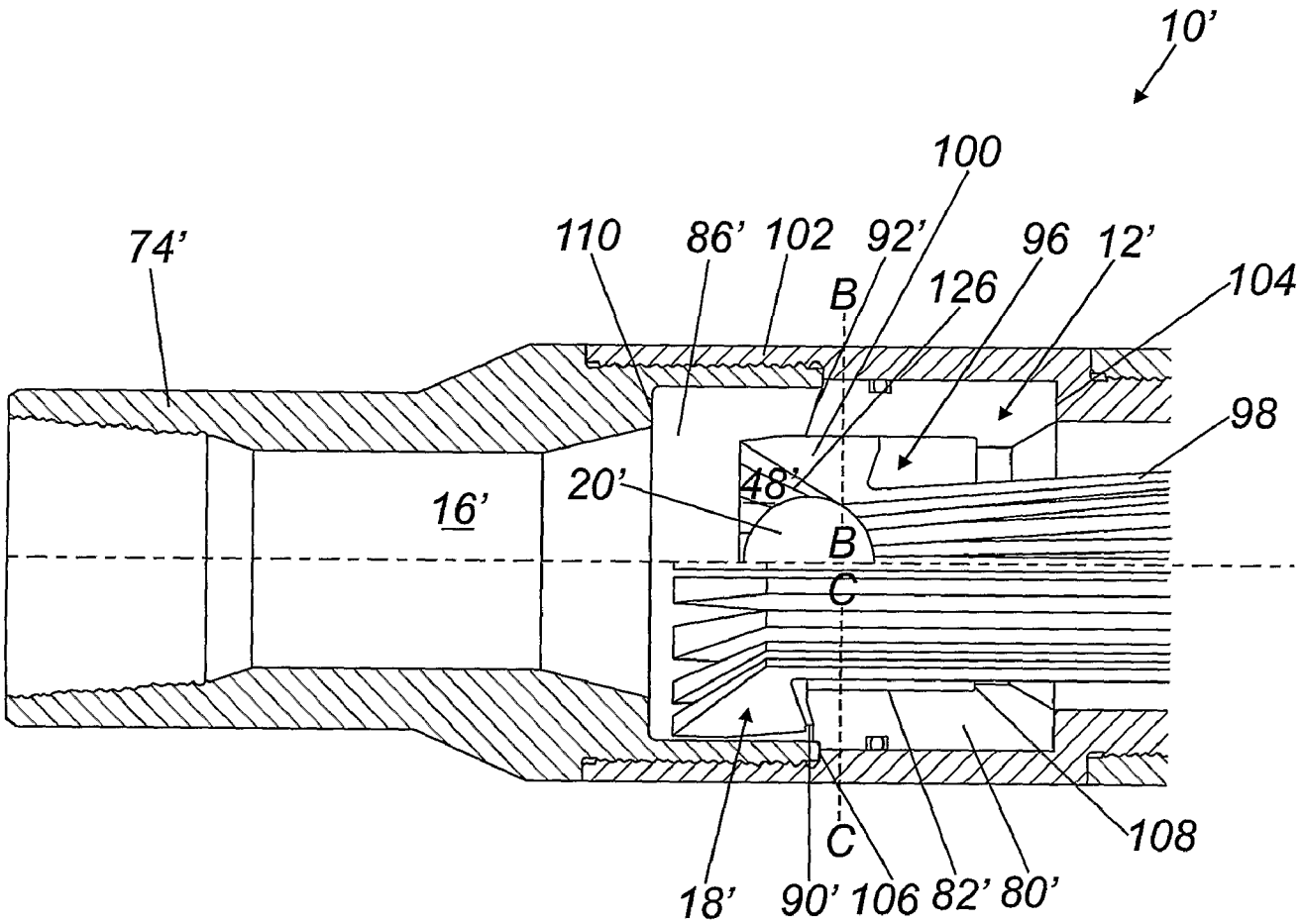
FIGS. 4 to 6 are longitudinal cross-sectional views of a downhole tool, incorporating a ball seat assembly, in accordance with a preferred embodiment of the present invention and similar to the view of the tool shown in FIG. 1, FIGS. 4 to 6 illustrating to tool sequentially from top to bottom.
Figures 5, 8:
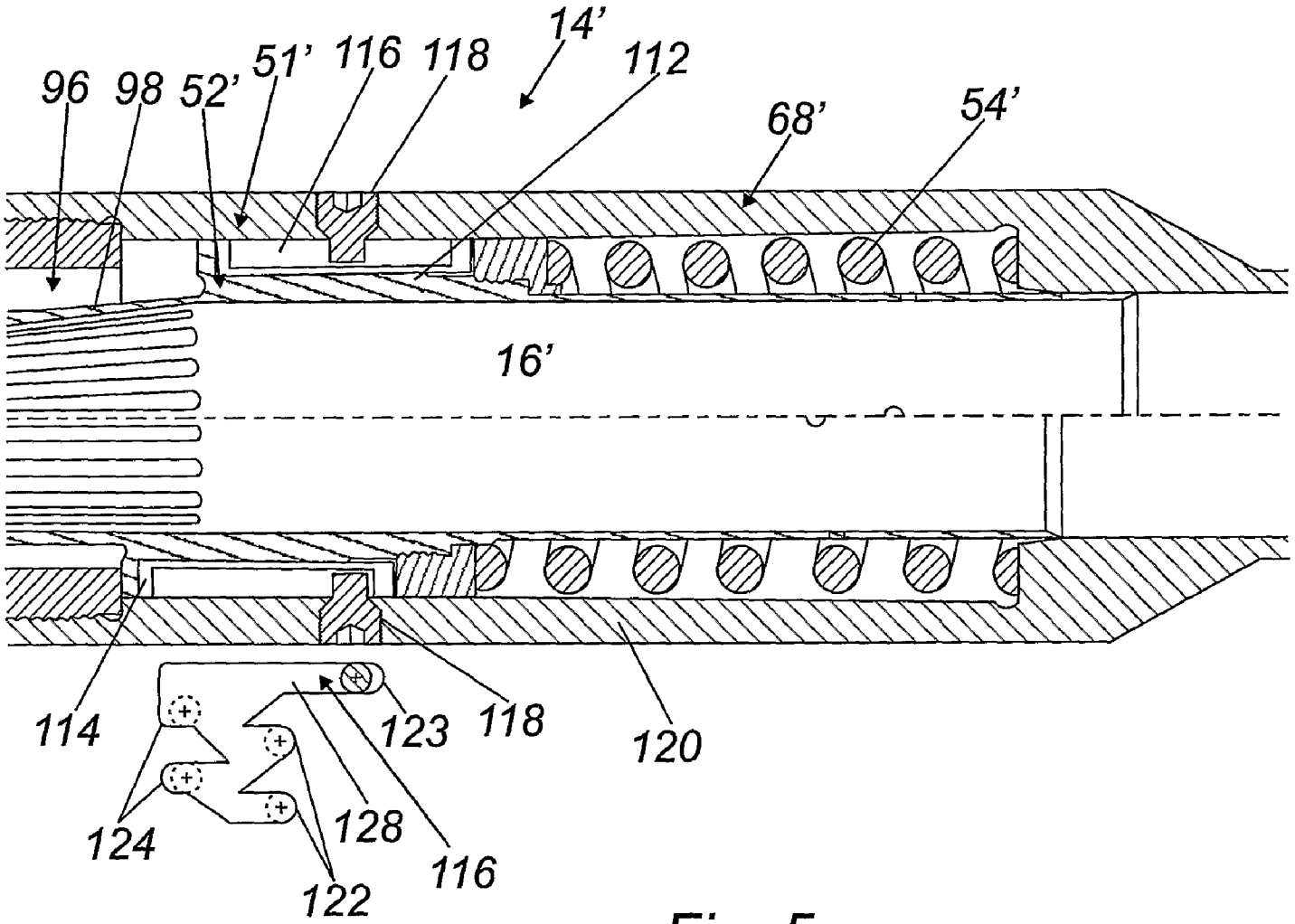
FIG. 8 (presented on same sheet as FIG. 5) is a developed circumferential view of an index channel of an indexing sleeve forming part of the ball seat assembly shown in FIGS. 4 to 6.
Figures 6, 7:
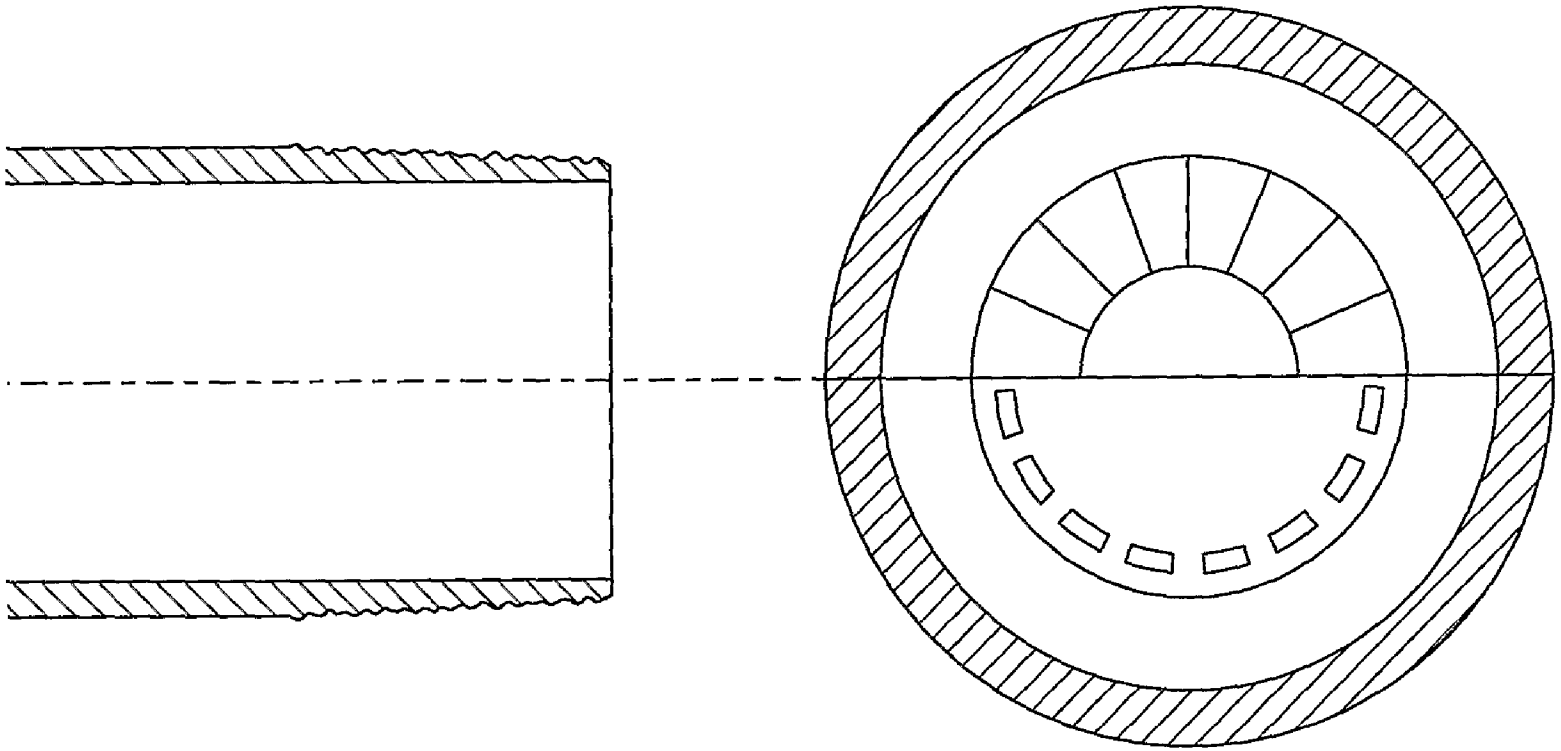
FIG. 7 is a cross-sectional view of the tool shown in FIGS. 4 to 6, a top half sectioned about line B-B of FIG. 4 and showing a ball seat of the assembly in an extended position, and a lower half sectioned about line C-C of FIG. 4 and showing the ball seat in a retracted position.

Turning now to FIGS. 4 to 6, there is shown sequentially from top to bottom, a downhole tool 10' incorporating a ball seat assembly 12', in accordance with a preferred embodiment of the present invention. Like components of the tool 10' with the tool 10 of FIGS. 1 and 2, and the ball seat assembly 12' with the ball seat assembly 12 of FIGS. 1 and 2, share the same reference numeral with the addition of the suffix '. However, only the substantial differences between the tools 10', 10 and the ball seat assemblies 12', 12 will be described herein in detail.

The assembly 12' includes a control mechanism 51' having a support sleeve 52' which carries a collet 96 at an upper end thereof. The collet 96 includes a number of sprung collet fingers 98, each of which includes a finger portion 100 of enlarged radial thickness at an end thereof.

A body 14' of the setting tool 10' includes a main portion 68', an upper sub 74' and an intermediate portion 102 which couples the upper sub 74' to the main portion 68'. The intermediate portion 102 includes a shoulder 104, and the tool 10' includes a shoulder portion 80' defined by a short sleeve located between the shoulder 104 and an end 106 of the upper sub 74'. The shoulder portion 80' includes an abutment surface 82' and a shoulder 108, and serves for maintaining a ball seat 18' defined by the collet finger portions 100 in an extended position, shown in the upper half of FIG. 4. A recess 86' is defined between the shoulder portion 80' and a shoulder 110 of the upper sub 74' which receives the collet finger portions 100 when in a retracted position, shown in the bottom half of FIG. 4.

A portion 112 of the support sleeve 52 carries an indexing sleeve 114, which defines a number of indexing channels (two shown) 116 that extend part way around a circumference of the sleeve 114. A number of indexing pins 118 (two shown) are located extending through a wall 120 of the body main portion 68' and locate in a respective indexing channel 116. Interaction between the pins 118 and the channels 116 controls axial and rotational motion of the support sleeve 52 relative to the tool body 14' and thus within a bore 16' of the tool.

The indexing channel 116 defines two first detent positions 122 and a second detent position 123, as well as two intermediate detent positions 124. These are best shown in the developed circumferential view of FIG. 8. In both the first detent positions 122 and the intermediate detent positions 124, the collet finger portions 100 are held in an axial position where they are supported by the shoulder portion surface 82'. The finger portions 100 are thus held in an extended position defining a restriction to passage of a ball 20' along the body bore 16', as shown in the upper half of FIG. 4. In the second detent position 123 however, the collet finger portions 100 are moved to a position where they can snap out into the recess 86' and thus axially overlap a side wall 92' of the recess 86'. In these retracted positions of the collet finger portions 100, the ball 20' is released to pass down the body bore 16' and out of the tool 10'.

Figure 3:
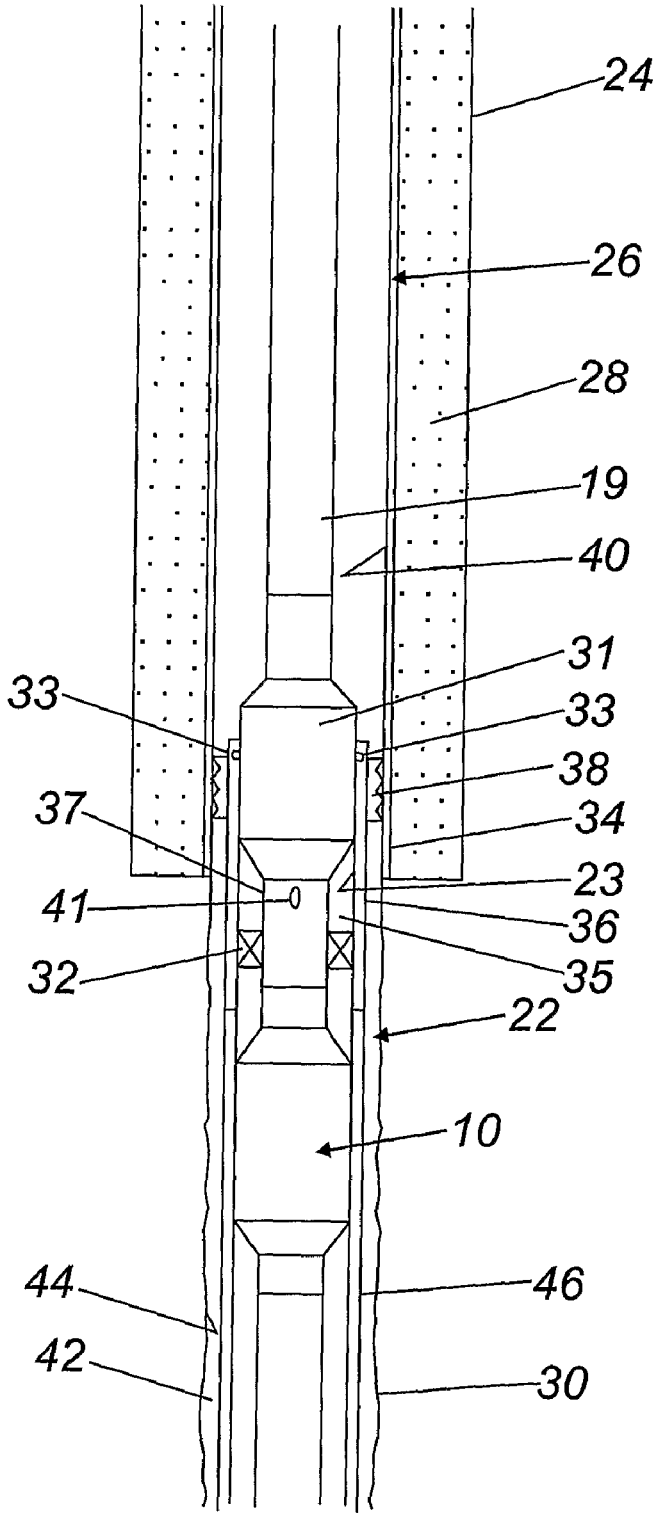
FIG. 3 is a schematic, partial longitudinal sectional view of the downhole of FIGS. 1 and 2 shown in use during the setting of a tubing in the form of a liner within a larger diameter casing located in a wellbore.

In use of the tool 10', the tool is made up to a work string such as the work string 19 in place of the tool 10 shown in FIG. 3. In a run-in position, shown in the upper half of FIGS. 4 to 6, the index pins 118 are engaged within first ones of the first detent positions 122 (the lower position shown in FIG. 8). When it is desired to activate a downhole tool such as the liner hanger 36 shown in FIG. 3, the ball 20' is dropped into the work string 19 and seats on a ball seat surface 48' defined by the collet finger portions 100. Although the fluid may bypass the ball 20' along the interfaces 126 between adjacent collet finger portions 100, fluid flow is substantially restricted. The fluid pressure force exerted on the ball seat 18' and thus upon the support sleeve 52 is raised, and acts against a biasing force of a spring 54'.

When this fluid pressure force has been raised to a sufficient level, by increasing the pressure of fluid in the work string 19, the support sleeve 52 is carried axially downwardly and is rotated such that the index pins 118 now reside in the first one of the intermediate detent positions 124. Further downward and rotational motion of the support sleeve 52 is prevented by engagement of the pins 118 in the intermediate detent positions 124. Also, the shoulder 108 on shoulder portion 80' arrests further downhole movement. The fluid pressure force is then reduced by bleeding off fluid pressure, and the spring 54' urges the support sleeve 52 uphole. However, the collet finger portions 100' are restricted from moving to their retracted positions.

This is because the indexing pins 118 now reside in the second one of the first detent positions 122, preventing movement of the support sleeve 52 to a position where the collet finger portions 100 are retracted.

By this mechanism, premature activation of the setting tool 10' is prevented. It is therefore necessary to carry out a further pressure cycle, moving the indexing pins 118 from the second one of the first detent positions 122 to the second one of the intermediate detent positions 124. When fluid pressure is then again bled off, the pins 118 move into respective long arms 128 of the indexing channel 116, and come to rest in the second detent position 123. As with the tool 10 described above, this is only possible when the fluid pressure is bled to a sufficiently low level which, again, is set to be around 50 psi, according to the dimensions and rating of the spring 54'.

When trailing edges 90' of the collet finger portions 100 pass beyond the side wall 92 of the recess 86, the sprung collet fingers 98 snap radially outwardly such that the finger portions 100 now reside within the recess 86'. The ball 20' is then released and can pass through the body bore 16' and out of the tool 10'. This is best shown in FIG. 7, the upper half of which is sectioned along line B-B of FIG. 4 and which shows the finger portions 100 extended; and the lower half of which is sectioned along line C-C and shows the finger portions 100 retracted. The method and operation of the tool 10' is otherwise as described above in relation to the tool 10.

It will readily be understood by persons skilled in the art that the tools 10 and 10' may be utilised in a wide range of downhole operations/procedures, and thus for activating a wide range of alternative downhole tools. For example, the tools 10 and 10' may be provided as part of a tool string carrying a fluid actuated circulation tool; a cleaning tool; a valve assembly; a perforation tool; a packer; a milling tool or the like or any combination thereof.

Various modifications may be made to forgoing without departing from the spirit and scope of the present invention.

The invention claimed is:

1. A ball seat assembly comprising:

a hollow body defining a body bore; and a ball seat mounted within the body bore, the ball seat being movable relative to the body bore between an extended position in which the ball seat defines a restriction to passage of a ball along the body bore, and a retracted position spaced axially along the body bore from the extended position and in which position passage of a ball along the body bore is permitted;

wherein, in use, landing a ball on the ball seat when in the extended position restricts fluid flow though the body bore, causing an increase in a fluid pressure force acting on the ball seat for a given fluid pressure;

and further wherein a subsequent reduction in the fluid pressure force acting on the ball seat facilitates movement of the ball seat from the extended position to the retracted position, to permit passage of the ball through the body bore to re-open fluid flow therethrough.

2. The assembly claimed in claim 1, wherein the ball seat is movable to the retracted position by a subsequent reduction in the pressure of fluid acting on the ball and thus on the ball seat.

3. The assembly claimed in claim 1, wherein the ball seat is moveable from the extended position to the retracted position in an uphole direction.

4. The assembly claimed claim 1, wherein a ball is adapted to be passed down into the body bore in a first axial direction, and the ball seat is selectively moveable relative to the body bore in a second axial direction opposite to said first axial direction between the extended and retracted positions.

5. The assembly claimed claim 1, further comprising a recess extending around an internal surface of the body, the recess adapted to receive at least part of the ball seat when the ball seat is moved from the extended position to the retracted position.

6. The assembly claimed claim 1, further comprising a control mechanism for controlling movement of the ball seat from the extended position to the retracted position, to selectively permit passage of a ball along the body bore and thus to selectively re-open fluid flow therethrough.

7. The assembly claimed in claim 6, wherein the control mechanism is activatable to move the ball seat from the extended position to the retracted position in response to the reduction in the fluid pressure force applied to the ball seat and thus to the ball when seated on the ball seat in the extended position.

8. The assembly claimed in claim 6, further comprising a biasing member for exerting a biasing force on the ball seat, to bias the ball seat towards the retracted position.

9. The assembly claimed claim 1, further comprising a restraint for restraining the ball seat against movement relative to the body bore.

10. The assembly claimed in claim 9, wherein the restraint is adapted to release the ball seat for movement relative to the body bore on exposure of the ball seat to a fluid pressure force at or above a determined level.

11. The assembly claimed claim 1, further comprising a plurality of ball seat elements in the form of arcuate dogs, the dogs being moveable relative to the body bore between extended and retracted positions and together defining a generally annular ball seat when the dogs are in their respective extended positions.

12. The assembly claimed claim 1, wherein the body comprises a body portion defining a shoulder adapted to abut the ball seat, to support and maintain the ball seat in the extended position.

13. The assembly claimed in claim 12, wherein the body portion defines an internal diameter which, when the ball seat is located axially adjacent to said portion, maintains the ball seat in the extended position defining the restriction.

14. The assembly claimed in claim 1, further comprising a control mechanism for controlling movement of the ball seat from the extended position to the retracted position, to selectively permit passage of a ball along the body bore and thus to selectively re-open fluid flow therethrough, the control mechanism comprising a support member coupled to the ball seat such that movement of the ball seat from the extended position to the retracted position is governed by the support member.

15. The assembly claimed in claim 14, further comprising a biasing member for urging the ball seat towards the retracted position, the biasing member adapted to act on the support member to thereby urge the ball seat towards the retracted position.

16. The assembly claimed in claim 14, wherein the ball seat comprises a plurality of ball seat elements, and wherein the support member comprises an aperture for each ball seat element, the ball seat elements mounted for radial movement relative to the body bore within the respective apertures.

17. The assembly claimed in claim 1, further comprising a collet having a plurality of sprung collet fingers, the collet fingers together defining the ball seat.

18. The assembly claimed in claim 17, wherein the collet fingers comprise finger portions having inner surfaces each defining part of a surface of the ball seat and adapted to abut the ball.

19. The assembly claimed in claim 18, wherein the finger portions are of a larger radial thickness relative to at least an adjacent portion of the fingers, and are adapted to engage in a recess or in the body when the ball seat is moved to the retracted position.

20. The assembly claimed in claim 17, wherein the finger portions comprise surfaces which are inclined, in use, in a downhole direction to resist movement of the ball seat from the retracted position.

21. The assembly claimed claim 1, further comprising a control mechanism for controlling movement of the ball seat from the extended position to the retracted position, to selectively permit passage of a ball along the body bore and thus to selectively re-open fluid flow therethrough, and wherein the control mechanism comprises an indexing arrangement including:

an indexing sleeve coupled to the ball seat, the indexing sleeve having an indexing channel extending at least part way around a circumference of the sleeve; and at least one indexing pin adapted to engage within the indexing channel.

22. The assembly claimed in claim 21, wherein the indexing channel comprises a plurality of axially and circumferentially spaced detent positions.

23. The assembly claimed in claim 22, wherein the indexing channel comprises at least one first detent position in which the ball seat is in the extended position; and at least one second detent position, axially and circumferentially spaced from the first detent position, in which the ball seat is in the retracted position.

24. The assembly claimed in claim 23, wherein the indexing channel comprises at least one further detent position, which is an intermediate detent position axially and circumferentially spaced from the first and second detent positions and in which position the ball seat is in a further position in which the ball seat maintains a restriction to passage of a ball through the body bore.

25. The assembly claimed in claim 1, wherein the ball seat assembly is for a downhole tubing setting tool.

26. A downhole tool comprising a ball seat assembly as claimed in claim 1.

27. The downhole tool claimed in claim 26, wherein the downhole tool is a tubing setting tool.

28. A method of controlling fluid flow through a hollow body, the method comprising the steps of:

mounting a ball seat within a bore of the body;

locating the ball seat in an extended position in which the ball seat defines a restriction to passage of a ball along the body bore;

bringing a ball into abutment with the ball seat, to restrict fluid flow through the body bore and thereby causing an increase in a fluid pressure force acting on the ball seat for a given fluid pressure; and subsequently lowering the fluid pressure force acting on the ball seat, to facilitate movement of the ball seat from the extended position to a retracted position spaced axially along the body bore from the extended position, in which position the ball seat releases the ball and permits passage of the ball along the body bore to thereby re-open fluid flow along the body bore.

29. The method claimed in claim 28, wherein the method is a method of hanging a tubing in a downhole environment.

30. The method claimed in claim 29, wherein the method is a method of hanging a liner from a larger diameter tubing in a wellbore.

31. The method claimed in claim 29, wherein the method further comprises providing a tubing setting tool defining the hollow body and controlling fluid flow through the hollow body of the setting tool in order to hang a tubing downhole.

32. The method claimed in claim 31, wherein the downhole tool is coupled to the tubing and serves for actuating a tubing hanger on the tubing.

33. The method claimed in claim 32, wherein the hanger is activated by raising fluid pressure in the tool above the ball to activate the hanger, and then reducing the fluid pressure to facilitate movement of the ball seat to the retracted position, to re-open flow.

34. The method claimed in claim 28, wherein the method is a method of selectively activating a downhole tool selected from a group comprising a cleaning tool; a packer; a milling tool; and a circulation tool for carrying out a downhole procedure.

35. The method claimed in claim 28, further comprising raising a fluid pressure force acting on the ball after the ball has been brought into abutment with the ball seat, to carry out a further downhole procedure.

36. The method claimed in claim 35, further comprising raising the pressure of fluid in the body bore upstream of the ball.

37. The method claimed in claim 35, further comprising subsequently lowering the fluid pressure force acting on the ball, by lowering the pressure of fluid in the body bore upstream of the ball, to facilitate movement of the ball seat to the retracted position.

38. The method claimed in claim 28, further comprising raising a fluid pressure force acting on the ball after the ball has been brought into abutment with the ball seat, to release a restraint which restrains movement of the ball seat relative to the body bore.

* * * * *